US012735904B2

(12) United States Patent
Meinders

(10) Patent No.: US 12,735,904 B2
(45) Date of Patent: Sep. 15, 2026

(54) ATTACHMENT FOR SCREEDING CONCRETE

(71) Applicant: Meinders Concrete Construction, Inc., Milan, IN (US)

(72) Inventor: Chad Meinders, Milan, IN (US)

(73) Assignee: Meinders Concrete Construction, Inc., Milan, IN (US)

( * ) Notice: Subject to any disclaimer, the term of this patent is extended or adjusted under 35 U.S.C. 154(b) by 346 days.

(21) Appl. No.: 18/624,761

(22) Filed: Apr. 2, 2024

(65) Prior Publication Data

US 2024/0337115 A1 Oct. 10, 2024

Related U.S. Application Data

(60) Provisional application No. 63/494,601, filed on Apr. 6, 2023.

(51) Int. Cl.
*E04F 21/24* (2006.01)

(52) U.S. Cl.
CPC ..... *E04F 21/242* (2013.01)

(58) Field of Classification Search
CPC ..... E04F 21/242
USPC ..... 404/75, 83, 120
See application file for complete search history.

(56) References Cited

U.S. PATENT DOCUMENTS 4,215,495 A * 8/1980 Wagner ..... E02F 3/815 172/26
4,655,633 A * 4/1987 Somero ..... E01C 19/006 404/75
4,708,520 A 11/1987 Rowe
4,930,935 A * 6/1990 Quenzi ..... E01C 19/405 404/114
4,978,246 A * 12/1990 Quenzi ..... E04F 21/242 356/141.3
5,039,249 A * 8/1991 Hansen ..... E04F 21/242 404/114
6,322,287 B1 11/2001 Yelton
6,953,304 B2 10/2005 Quenzi et al.
7,144,191 B2 12/2006 Kieranen et al.
7,559,719 B2 7/2009 Nasby
8,152,409 B1 4/2012 Ligman
9,045,871 B2 6/2015 Graham et al.
9,909,267 B1 3/2018 Ligman
10,132,047 B2 11/2018 Terstriep
(Continued)

OTHER PUBLICATIONS

Concrete Screeds & Gravel Graders for Skid Steers [online], [retrieved on Apr. 2, 2024], Retrieved from <https://www.dragonscreed.com/skid-steer-screed>.

*Primary Examiner* — Raymond W Addie
(74) *Attorney, Agent, or Firm* — Woodard, Emhardt, Henry, Reeves & Wagner, LLP

(57) ABSTRACT

A screeding apparatus includes a mounting assembly for attaching the screeding apparatus to a construction vehicle such as a skid steer or a mini excavator. The screeding apparatus also includes a mainframe comprising a boom that extends from the mounting assembly and a screed head assembly that attaches to the mainframe. The screed head assembly may include a slider assembly that may slide along the boom of the mainframe to move the screed head assembly may move along the mainframe. Elevation actuators on the screed head assembly allow the height of the screed head assembly to be adjust to provide a level surface for the screeded concrete.

20 Claims, 6 Drawing Sheets

(56) References Cited

U.S. PATENT DOCUMENTS

| | | | | |
|---|---|---|---|---|
| 10,865,045 | B2 | 12/2020 | Gabner | |
| 11,162,232 | B2 | 11/2021 | Ligman et al. | |
| 11,479,928 | B2 | 10/2022 | Pasqualotto | |
| 2002/0154948 | A1* | 10/2002 | Brabec | E01C 19/004 404/75 |
| 2009/0092444 | A1 | 4/2009 | Schoen | |
| 2022/0064971 | A1 | 3/2022 | Halonen et al. | |
| 2022/0162814 | A1 | 5/2022 | Ligman | |
| 2022/0267967 | A1 | 8/2022 | Ligman | |
| 2023/0295884 | A1* | 9/2023 | Ligman | E01C 19/405 404/118 |

* cited by examiner

ATTACHMENT FOR SCREEDING CONCRETE

BACKGROUND

Concrete is a commonly used building material that is formed by an aggregate that is bonded together with a fluid cement. When the aggregate is mixed with the cement, a slurry or a wet concrete is formed that may be poured and molded into a desired shape. The slurry may be cured so that the slurry hardens into a formed, concrete structure. It may be desired for the concrete structure to have smooth, level surfaces. This can be accomplished by screeding the wet concrete with a screeding device to produce the desired smoothness and level of the concrete. It may be desired to make the screeding process as accurate and as quick as possible. Therefore, improvement is needed in this field.

SUMMARY

Certain embodiments include a screeding apparatus. The screeding apparatus may include a mounting assembly for attaching the screeding apparatus to a construction vehicle such as a skid steer or a mini excavator. The mounting assembly may include a mounting base and a tilt rotator assembly. The mounting base may include a pair of base supports with attached wheels for supporting the screeding apparatus on the ground or other suitable support surface. The mounting base may also include a crossbar that extends between the base supports. In some examples, the crossbar may be slidable with respect to the base supports to allow a user to modify the height of the crossbar.

The tilt rotator assembly may be attached to the mounting base and may be configured to attach to a connection point on the construction vehicle on which the screeding apparatus is to be attached. The tilt rotator assembly may include a tilt controller that is hingeable to allow an upper bracket to pivot with respect to a lower bracket to properly align with an attachment point of the construction vehicle. In some instances, the tilt rotator assembly may be rotatable with respect to the mounting base.

The screeding apparatus may also include a mainframe that extends from the mounting assembly. The mainframe may include a boom that has a proximal end and a distal end. A slide rail may extend from each side of the boom. A slide control rod connection may extend from a front edge of the boom. A slide control rod may connect to the boom at the slide control rod and extend along a length of the boom. In some examples, the slide control rod may be cantilevered from the slide control rod connection.

A screed head assembly may be attached to the mainframe so that the screed head assembly is slidable along the length of the boom of the mainframe. The screed head assembly may include a screed head body and an adjustable plow may be attached at a rear edge of the screed head body. A finish plate assembly may be attached at a front edge of the screed head body. The finish plate assembly may include a connection plate that connects to the screed head body and a finish plate that extends from the connection plate. The connection plate may be slidable with respect to the screed head body, allowing a suer to adjust the height of the finish plate with respect to the screed head body. A vibration actuator may be positioned on the finish plate to allow vibration of the finish plate during operation of the screeding apparatus.

An auger assembly may also be attached to the screed head body and may extend below the screed head body. The auger assembly may include a first auger and a second auger. The first auger and the second auger may be flighted in opposite directions. The augers may be connected to each other by an auger attachment and an auger actuator may be connected between the screed head body and the auger attachment. The auger actuator may pivot the auger assembly to allow either the first auger to be positioned lower than the second auger or to allow the second auger to be positioned lower than the first auger.

A slider assembly may be attached to a top surface of the screed head body. The slider assembly may include a slider mechanism that defines a slide control opening for receiving the slide control rod of the mainframe. The slider assembly may also define a boom opening for receiving the boom of the mainframe so that the slider assembly is slidable along the length of the boom. The slider assembly may be coupled to the screed head body by an elevation control system that includes one or more elevation actuators which may allow the height of the slider assembly with respect to the screed head body to be adjusted.

A method may comprise attaching the screeding apparatus to a vehicle. The screeding apparatus may be attached to the vehicle at the tilt rotator assembly of the mounting assembly. The screeding apparatus may be positioned at a location to be screeded. An auger actuator of the auger assembly of the screeding apparatus may be operated to pivot the auger assembly so that a first auger is positioned lower than a second auger and positioned at least partially within a material to be screeded. The slider assembly and the screed head assembly may be slid along a length of the boom while rotating the first auger. In some instances, the slider assembly and the screed head assembly are slid from a distal end of the boom to a proximal end of the boom attached to the mounting assembly.

In some examples, the auger actuator may be operated to pivot the auger assembly so that the second auger is positioned lower than the first auger and so that the second auger positioned at least partially within the material to be screeded. The second auger may have a direction of flighting that is opposite of the first auger so that the material to be screeded is pushed in the opposite direction as when the first auger is lowered. The vibration actuator may be operated to vibrate the finish plate assembly to smooth the material being screeded as the screed head assembly is slid along the length of the boom.

Further forms, objects, features, aspects, benefits, advantages, and embodiments of the present invention will become apparent from a detailed description and drawings provided herewith.

DESCRIPTION OF THE SELECTED EMBODIMENTS

Figure 1:
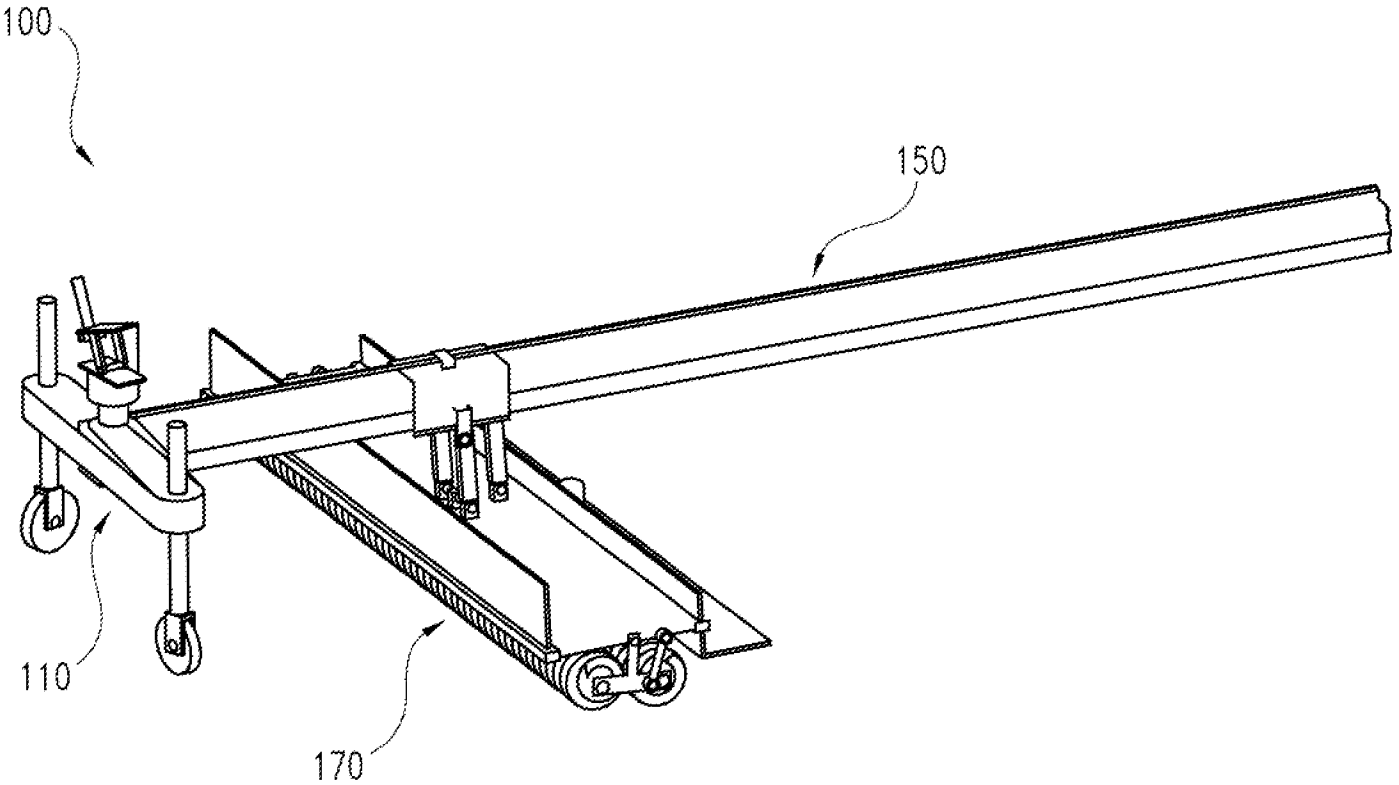
FIG. 1 is a perspective view of a screeding assembly.

For the purpose of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates. One embodiment of the invention is shown in great detail, although it will be apparent to those skilled in the relevant art that some features that are not relevant to the present invention may not be shown for the sake of clarity.

Directional terms, such as forward, rearward, top, bottom, etc., may be used in this description with reference to the specific embodiment shown and used for purposes of clarity. It should be recognized that these terms are not meant to be limiting.

FIG. 1 illustrates a screeding apparatus 100 useful for leveling and/or smoothing poured concrete or another suitable material. The screeding apparatus 100 includes a mounting assembly 110 for attaching the screeding apparatus 100 to a construction vehicle such as a skid steer or a mini excavator. The screeding apparatus 100 also includes a mainframe 150 that extends from the mounting assembly 110. A screed head assembly 170 is attached to the mainframe 150 so that the screed head assembly 170 may move along the mainframe 150.

Figure 2:
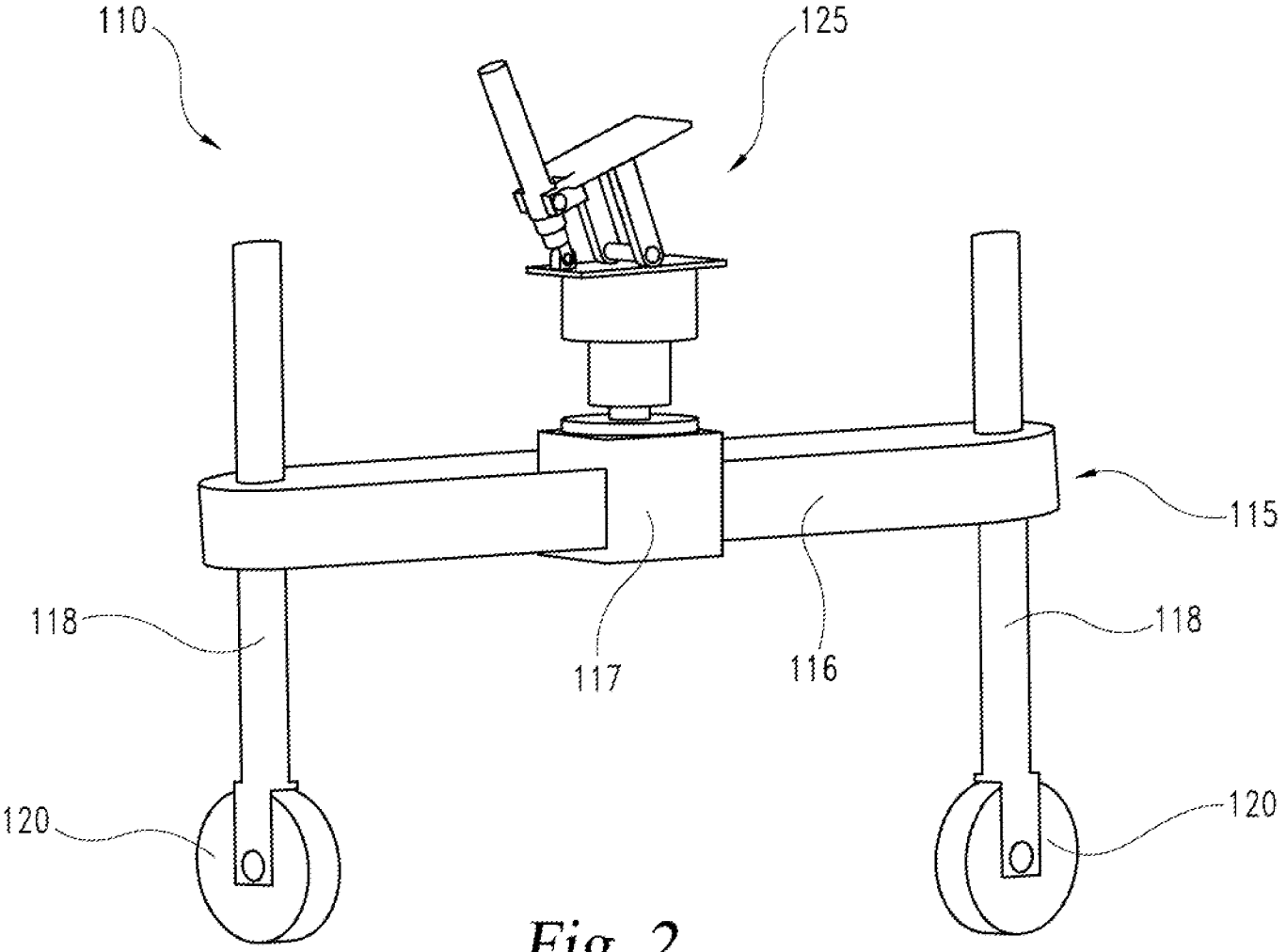
FIG. 2 is a perspective view of a mounting assembly of the screeding assembly of FIG. 1.

The mounting assembly 110 is shown in more detail in FIG. 2 and includes a mounting base 115 and a tilt rotator assembly 125. The mounting base 115 comprises a crossbar 116 including an attachment portion 117 for connecting the tilt rotator assembly 125 to the mounting base 115. In the embodiment shown, the attachment portion 117 of the crossbar 116 has a cubical shape and protrudes from the crossbar 116. However, in other embodiments, the attachment portion 117 may be any suitable, desired shape. In still other embodiments, the attachment portion 117 may not protrude from the crossbar 116 and may be the same shape and flush with the crossbar 116.

The mounting base 115 also includes a pair of base supports 118, with one of the base supports 118 positioned at each end of the crossbar 116. In the embodiment shown, a wheel attached to each of the base supports 118, allowing the mounting base 115 of the mounting assembly 110 to be easily moved along a surface. In other embodiments, the base support 118 may not include a wheel 120 but instead may include a stationary foot, a unitary base, or any other suitable contact point for resting on a support surface supporting the screeding apparatus 100.

In some embodiments, the base supports 118 may be inserted through an opening defined through the crossbar 116. This allows the crossbar 116 to be slidable along the base supports so that the height of the crossbar 116 may be modified as desired. In other embodiments, the base supports 118 may be fixedly attached to the crossbar 116.

Figure 3:
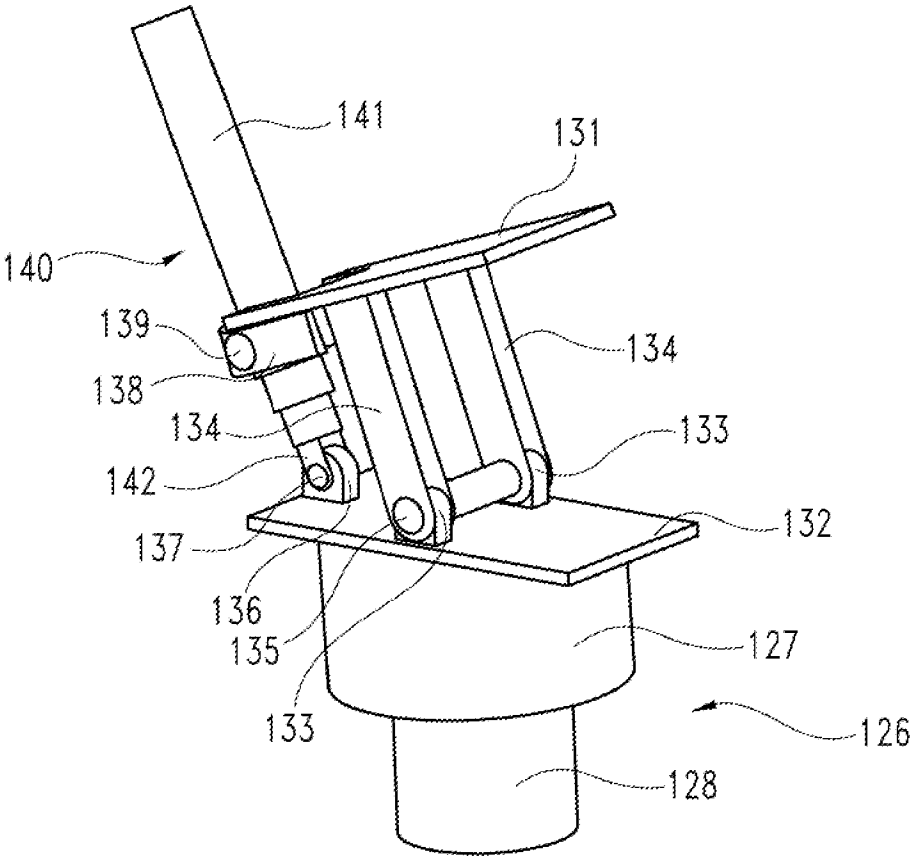
FIG. 3 is a perspective view of a tilt rotator assembly of the mounting assembly of FIG. 2.

The mounting assembly 110 also includes a tilt rotator assembly 125 that is attached to the mounting base 115. The tilt rotator assembly 125 is shown in more detail in FIG. 3. The tilt rotator assembly 125 may connect to an excavator, a skid steer, or any other suitable equipment. The tilt rotator assembly 125 allows the screeding apparatus 100 to tilt and/or rotate as desired. In some embodiments, the tilt rotator assembly 125 may allow 360 degree rotation of the screeding apparatus 100.

In the embodiment shown, the tilt rotator assembly 125 is attached to the base at the attachment portion 117 of the crossbar 116. The tilt rotator assembly 125 includes a tilt rotator base 126. In the embodiments shown, the tilt rotator base 126 includes a main rotator base portion 127 and a rotator base extension 128. As shown in FIG. 2, the rotator base extension 128 of the tilt rotator base 126 may fit within an opening defined in the attachment portion 117 of the crossbar 116 to attach the tilt rotator assembly 125 to the mounting base 115. In some embodiments, the tilt rotator base 126 may be attached to the crossbar 116 so that the tilt rotator assembly 125 may rotate with respect to the crossbar 116 of the mounting base 115.

The tilt rotator assembly 125 also includes a rotator attachment assembly 130 positioned on the tilt rotator base 126. The rotator attachment assembly 130 may be used to connect the screeding apparatus to a construction vehicle such as a skid steer or a mini excavator. The rotator attachment assembly 130 includes an upper bracket 131 and a lower bracket 132. The lower bracket 132 may include rotator attachment eyelets 133 that extend from a surface of the lower bracket 132. A pair of supports 134 extend between the upper bracket 131 and the lower bracket 132. The supports may be integral to the upper bracket 131 or may be otherwise attached permanently or removably attached to the upper bracket 131.

In some embodiments, the supports 134 may be pronged so that one prong of the support 134 is positioned on one side one of the rotator attachment eyelets 133 on the lower bracket, and the other prong of the support 134 is positioned on the other side of the rotator attachment eyelet 133. A bracket pin 135 may extend through openings defined through the prongs of the supports 134 and through an opening defined through each of the rotator attachment eyelets 133 to hingedly connect the supports 134 to the lower bracket 132. It should be recognized, that in some embodiments, the rotator attachment eyelets 133 may be pronged and the support 134 may be fit within the prong of the rotator attachment eyelets 133.

The rotator attachment assembly 130 may also include a tilt controller 140. The tilt controller 140 includes a tilt controller body 141 and a tilt controller base 142. The tilt controller base 142 may be pronged and may attach to the lower bracket 132 at a tilt controller eyelet 136. In other embodiments, the tilt controller eyelet 136 on the lower bracket 132 may be pronged and the base 142 of the tilt controller 140 may fit within the prongs of the tilt controller eyelet 136. A tilt controller connector 137, such as a pin, may be inserted through openings in the tilt controller base 142 and the tilt controller eyelet 136 to allow tilt controller 140 to hinge with respect to the lower bracket 132.

Prongs 138 may extend from the upper bracket 131 and surround the body 141 of the tilt controller 140. An upper bracket connector 139, such as a pin, may be inserted through openings defined in the prongs 138 and defined through the body 141 of the tilt controller 140 to connect the tilt controller 140 to the upper bracket 131. Therefore, a user may pull or push on the tilt controller 140 to pivot the tilt controller 140 with respect to the lower bracket 132 and the tilt rotator base 126. Rotation of the tilt controller 140 also causes rotation of the upper bracket 131 and the supports 134 so that these components also pivot with respect to the lower bracket 132 and the tilt rotator base 126 when a force is applied on the tilt controller 140.

Figure 4:
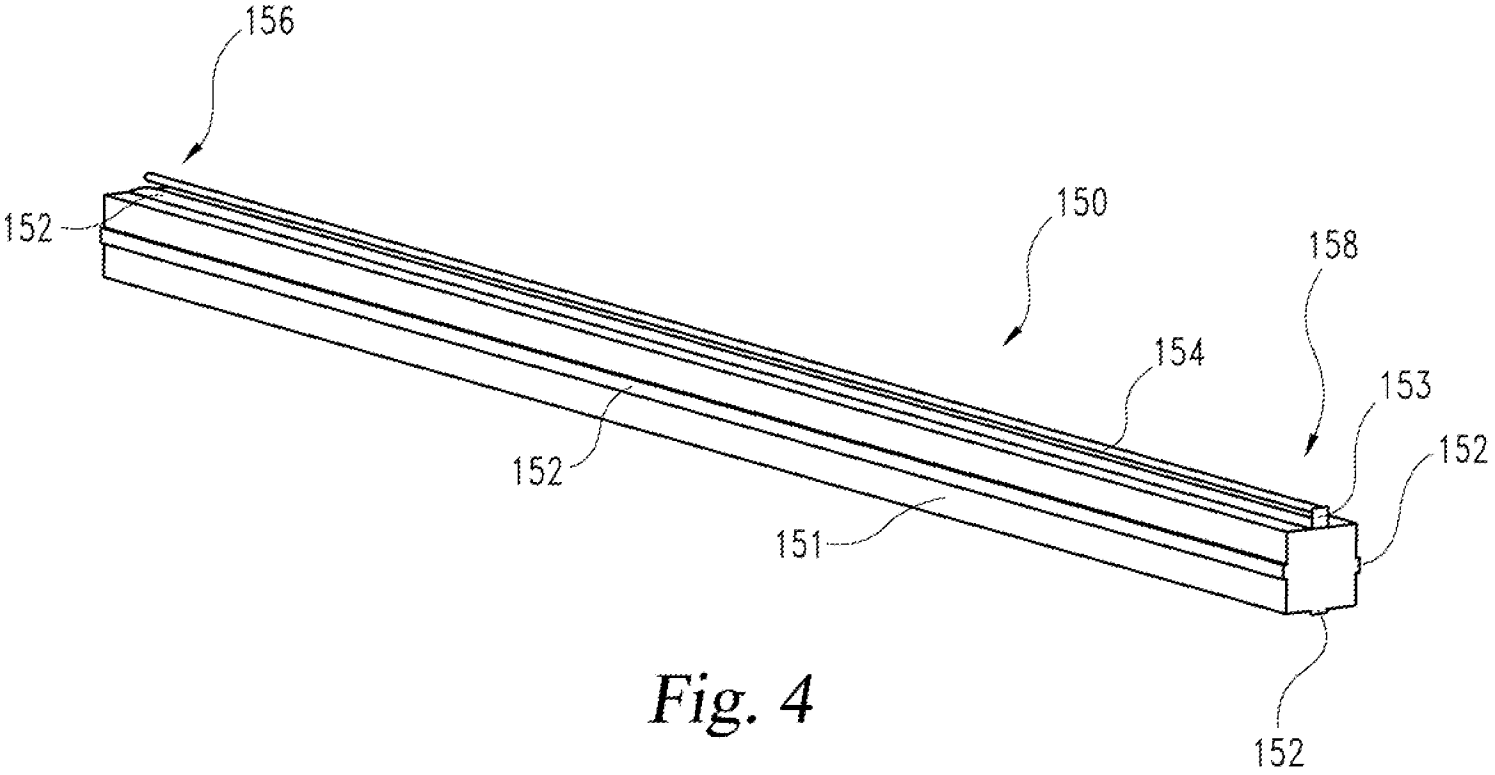
FIG. 4 is a perspective view of a mainframe of the screeding assembly of FIG. 1.

A perspective view of the mainframe 150 of the screeding apparatus 100 is illustrated in FIG. 4. The mainframe 150 includes a boom 151. The boom 151 has a proximal end 156 and a distal end 158. In the embodiment shown, the boom 151 has a generally rectangular cross-section. In other embodiments, the boom 151 may have a cross-section of any other suitable shape, such as circular or rectangular.

A slide rail 152 extends from each side of the boom 151. The slide rails 152 may help to guide screed head assembly 170 as the screed head assembly 170 slides along the boom 151 and to add durability to and reduce wear on the boom 151. Although in the embodiment shown in FIG. 4, each side of the boom 151 includes a slide rail 152, in other embodiments, the number of sides of the boom 151 that include a slide rail 152 may be modified as desired. For example, in some embodiments, only two sides or only three sides of the boom 151 may include a slide rail 152.

A slide control rod connection 153 may extend from a front edge of the top side of the boom 151. A slide control rod 154 connects to the telescoping boom at the slide control rod connection 153 and extend toward the rear edge of the boom 151. In the embodiment shown, the slide control rod is cylindrical and is cantilevered from the slide control rod connection 153. Along with the slide rails 152, the slide control rod 154 may also help guide the screed head assembly 170 as the screed head assembly 170 slides along the boom 151.

Figure 5:
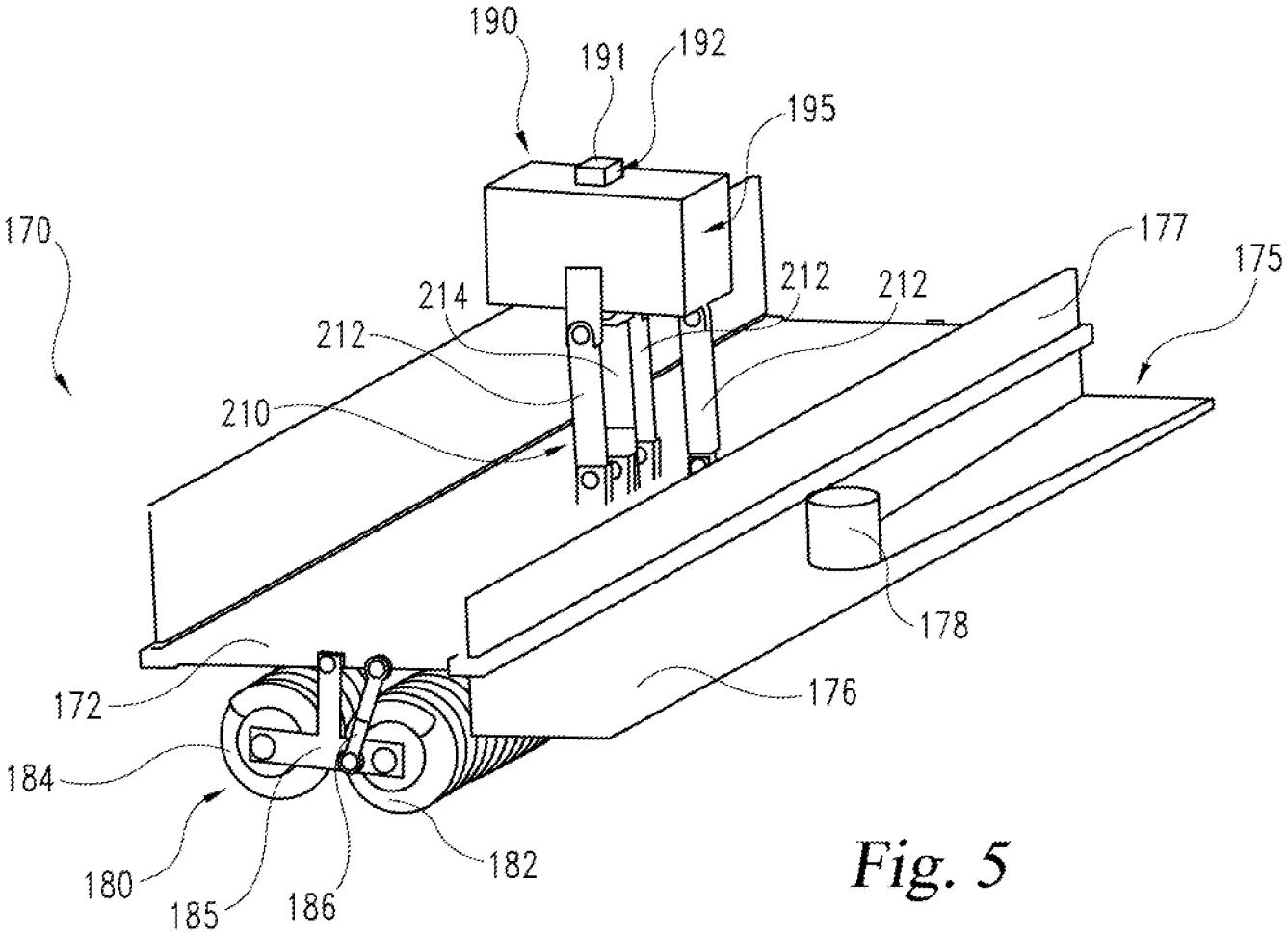
FIG. 5 is a perspective view of a screed head assembly of the screeding assembly of FIG. 1.

A perspective view of the screed head assembly 170 is shown in FIG. 5. The screed head assembly 170 includes a screed head body 172. An adjustable plow 174 is attached to and extends from a rear edge of the screed head body 172. The plow 174 may be used to move excess material out of the way of the auger assembly 180 and the finish plate 176. The height of plow 174 may be adjustable to set the desired level for the amount of material that is encountered by the auger assembly 180 and the finish plate 176.

A finish plate assembly 175 is attached to a front edge of the screed head body 172. The finish plate assembly 175 includes a finish plate 176 and a connection plate 177. In the embodiment shown, the finish plate 176 is arranged to extend generally parallel with respect to the screed head body 172 and to be generally perpendicular with respect to the connection plate 177. The connection plate 177 may be coupled to the screed head body 172. In some embodiments, the connection plate 177 is slidable with respect to the screed head body 172, allowing a user to adjust the position of the finish plate assembly 175 with respect to the screed head body 172.

A vibration actuator 178 may be positioned on the finish plate 176. The vibration actuator 178 may be operated to vibrate the finish plate 176 to assist with smoothing and leveling the concrete being worked on by the screeding apparatus 100 by dispersing aggregate and filling air pockets in the poured concrete.

An auger assembly 180 is attached to the screed head body 172 and positioned rearward of the finish plate assembly 175. The auger assembly 180 includes a first auger 182 and a second auger 184 positioned adjacent to and behind the first auger 182. In the embodiment shown, the first auger 182 and the second auger 184 each extend along the length of the screed head body 172. In some embodiments, the direction of the flighting on the augers 182, 184 may mirror each other, so that one of the augers 182, 184 has flighting directed to the left while the other auger 182, 184 has flighting directed to the right.

The auger assembly 180 also includes an auger attachment 185 that attaches the augers 182, 184 to the screed head body 172. An auger actuator 186 is attached between the auger attachment 185 and the screed head body 172. The auger actuator 186 allows the auger attachment 185 to pivot to determine which of the augers 182, 184 is in contact with the poured material, such as concrete. Typically, during use, only one of the augers 182, 184 is in contact with the material being screeded, while the other auger 182, 184 is pivoted to be positioned above the material being screeded. Since the augers 182, 184 have different direction of flighting, the direction in which the material being screeded is moved is determined by which auger 182, 184 is pivoted to be in contact with the material being screeded. The direction in which the material being screeded is moved can be switched by using the auger actuator 186 to pivot the augers 182, 184 so that the auger 182, 184 that was positioned above the screeded material is pivoted to be in contact with the material being screeded.

A slider assembly 190 is coupled to the top surface of the screed head body 172. The slider assembly 190 includes a slider mechanism 191 and a travel housing 194. The slider mechanism 191 extends from a surface of the travel housing 194. In the embodiment shown, the slider mechanism 191 extends from the top surface of the travel housing 194. The slider mechanism 191 includes a linear actuator, such as a hydraulic cylinder, that allows the slider assembly 190 to move along the boom 151 of the mainframe 150. In other embodiments, other suitable types of mechanical linear actuators, such a ball screw, or other suitable types of electric linear actuators, such as an electric motor, may be used to move the slider mechanism 191 along the boom 151. A slide control opening 192 is defined through the slider mechanism 191. The slide control opening 192 is configured to receive the slide control rod 154 attached to the boom 151 of the mainframe 150. A boom opening 195 is defined through the travel housing 194. The boom opening 195 is configured to receive the boom 151 of the mainframe 150.

The slider assembly 190 is coupled to the screed head body 172 by an elevation control system 210. The elevation control system 210 includes one or more slider linkages 212 that extend between the travel housing 194 and the screed head body 172. The slider linkages 212 may be flexible and/or compressible to allow vertical movement of the slider linkages. In the embodiment shown, the slider linkages 212 connect to the screed head body 172 at pronged connections. The slider linkages 212 are also connected to the travel housing 194 at pronged connections. The pronged connections between the slider linkages 212 and the screed head body 172 and the travel housing 194 allow the slider linkages 212 to pivot to adjust the height of the screed head assembly 170. In other embodiments, suitable alternative connection methods other than pronged connections that allow the slider linkages 212 to pivot and compress with respect to the slider assembly 190 may be used.

An elevation actuator 214, such as a hydraulic cylinder, may be used to adjust the height of the slider assembly 190 with respect to the screed head body 172. In the embodiment shown, one end of the elevation actuator 214 is attached to the screed head body 172 at a pronged connection. A second end of the elevation actuator 214 is attached to the slider assembly 190 at a pronged connection. In other embodiments, suitable alternative connection methods other than pronged connections for connecting the elevation actuator 214 to the screed head body 172 and the slider assembly 190 may be used.

Figure 6:
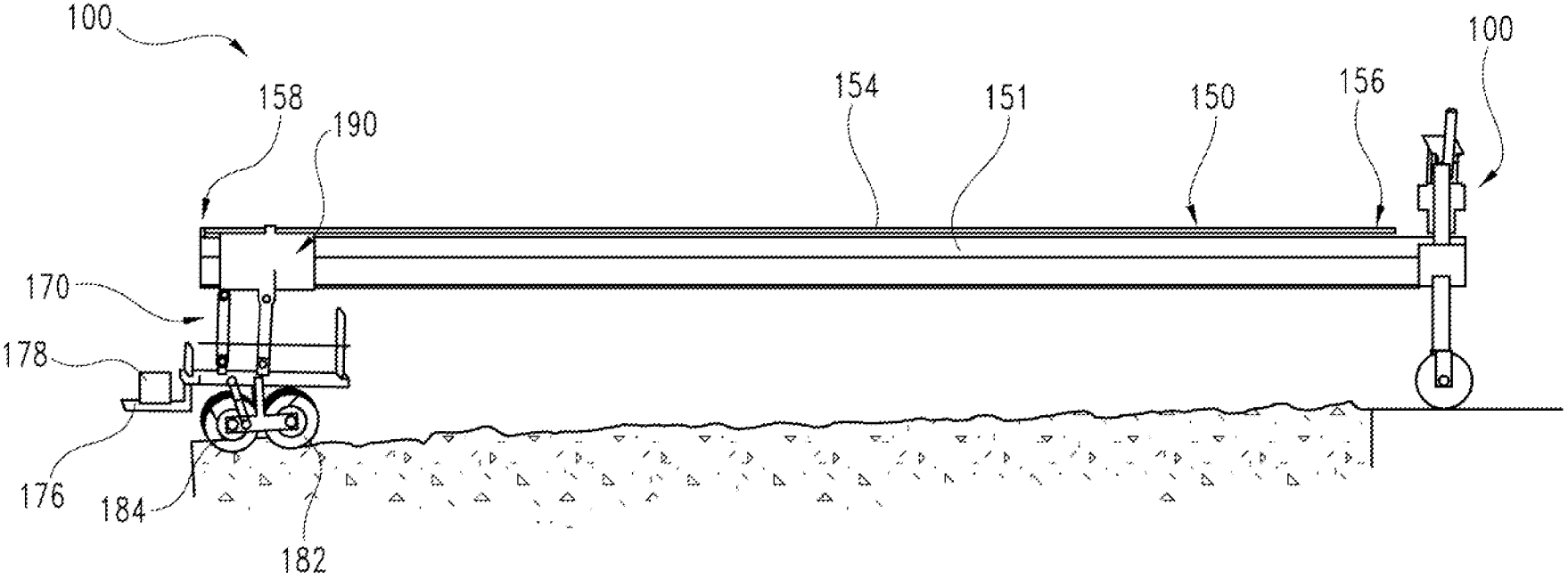
FIG. 6 is an illustration of the screeding assembly of FIG. 1 in use.

FIG. 6 illustrates the screeding apparatus 100 set up for operation. The screeding apparatus is positioned at a location where concrete is being poured or has recently poured and needs to be smoothed, flattened, and/or leveled. Typically, the screeding apparatus 100 is attached to a construction vehicle, such as a skid steer or a mini excavator. The construction vehicle may be used to move the screeding apparatus 100 into the desired position for screeding the poured concrete. In other embodiments, however, the screeding apparatus may be positioned in the desired location independently, without attachment to a construction vehicle.

The screed head assembly 170 is positioned at the distal end 158 of the boom 151 and lowered so that at least one of the augers 182, 184 is at least partially submerged within the poured concrete. The finish plate 176 is positioned either on the surface of the poured concrete or immediately adjacent to the surface of the poured concrete. The screed head assembly 170 is then moved along the mainframe 150. As the screed head assembly 170 moves along the mainframe 150, the slider assembly 190 slides along the boom 151 from the distal end 158 of the boom 151 to the proximal end 156 of the boom 151. The movement of the screed head assembly 170 along the mainframe 150 pulls the screed head assembly 170 across the surface of the poured concrete.

As the screed head assembly 170 moves along the mainframe 150, the augers 182, 184 rotate to grade the concrete and to displace any excess concrete to the side of the screeding apparatus 100. The auger actuator 186 is used to pivot the augers 182, 184 so that the auger 182, 184 that has flighting in the direction in which the concrete is desired to be moved is positioned lower than the other auger 182, 184, within the concrete. The direction of movement of the poured concrete can be switched by operating the auger actuator 186 to switch which auger 182, 184 is lower and positioned in the concrete. The finish plate 176 follows the augers 182, 184 and smooths and levels the poured concrete. In some instances, the vibration actuator 178 may cause the finish plate 176 to vibrate as the finish plate 176 moves over the concrete, assisting to disperse aggregate in the poured concrete and to reduce the likelihood of air pockets.

The height of the screed head assembly 170 to determine the level of the poured concrete may be set manually, or in some embodiments, may be set automatically using laser guidance or any other suitable guidance system. The guidance system may control the slider linkages 212 to adjust the height of the screed head assembly 170.

While the invention has been illustrated and described in detail in the drawings and foregoing description, the same is to be considered as illustrative and not restrictive in character, it being understood that only the preferred embodiment has been shown and described and that all changes, equivalents, and modifications that come within the spirit of the inventions defined by following claims are desired to be protected.

The invention claimed is:

1. A screeding apparatus comprising:

a mounting assembly;

a mainframe extending from said mounting assembly, wherein said mainframe includes a boom;

a slider assembly including a slider mechanism positioned around said boom;

a screed head assembly coupled to said slider assembly, wherein said screed head assembly includes a screed head body including a finish plate assembly and an auger assembly; and wherein said slider assembly is slidable along a length of said boom, and wherein said screed head assembly is pulled along the length of the boom with said slider assembly.

2. The screeding apparatus of claim 1, wherein said mounting assembly includes a mounting base comprising a crossbar and base supports at each end of said crossbar; and wherein said crossbar is slidable along a length of said base supports to modify a height of said crossbar.

3. The screeding apparatus of claim 1, further comprising:

an elevation control system including an elevation actuator, wherein a first end of said elevation actuators is connected to said slider assembly and a second end of said elevation actuator is connected to said screed head body; and wherein said elevation actuator is operable to adjust a height of the slider assembly with respect to the screed head body.

4. The screeding apparatus of claim 1, wherein said finish plate assembly is adjustable with respect to said screed head body.

5. The screeding apparatus of claim 1, further comprising:

a vibration actuator positioned on said finish plate assembly, wherein said vibration actuator is operable to vibrate said finish plate assembly.

6. The screeding apparatus of claim 1, wherein said mounting assembly includes a tilt rotator assembly and a mounting base, and wherein said tilt rotator assembly is rotatable with respect to said mounting base.

7. The screeding apparatus of claim 6, wherein said tilt rotator assembly comprises a tilt rotator base, a rotator attachment assembly attached to said tilt rotator base, and a tilt controller attached to said rotator attachment assembly; and wherein said tilt controller is configured to pivot said rotator attachment assembly with respect to said tilt rotator base when a force is applied on said tilt controller.

8. The screeding apparatus of claim 1, wherein said boom includes at least one slide rail, wherein said at least one slide rail extends from a side of said boom.

9. The screeding apparatus of claim 8, wherein said boom includes a plurality of slide rails, and wherein one of said plurality of slide rails extends from each side of said boom.

10. The screeding apparatus of claim 1, wherein said mainframe includes a slide control rod, and wherein said slide control rod is coupled to said slider assembly.

11. The screeding apparatus of claim 10, wherein said slide control rod is cantilevered from a slide control rod connection that extends from a side of said boom.

12. The screeding apparatus of claim 11, wherein said slide control rod connection is connected at a distal end of said boom.

13. The screeding apparatus of claim 1, wherein said auger assembly includes a first auger and a second auger.

14. The screeding apparatus of claim 13, wherein a direction of flighting on said first auger is opposite of a direction of flighting on said second auger.

15. The screeding apparatus of claim 14, further comprising:

an auger actuator attached between said auger assembly and said screed head body; and wherein said auger actuator is configured to pivot said auger assembly so that said first auger may be positioned lower than said second auger or so that said second auger may be positioned lower than said first auger.

16. A method comprising:

positioning a screeding apparatus at a location to be screeded, wherein said screeding apparatus comprises a mounting assembly, a mainframe including a boom, a slider assembly including a slider mechanism positioned around said boom, and a screed head assembly coupled to said slider assembly, wherein said screed head assembly includes a finish plate assembly and an auger assembly;

operating an auger actuator of said auger assembly to pivot said auger assembly so that a first auger is positioned lower than a second auger and positioned at least partially within a material to be screeded, wherein a direction of flighting on said first auger is opposite of a direction of flighting on said second auger; and sliding said slider assembly and said screed head assembly along a length of said boom while rotating said first auger.

17. The method of claim 16, wherein said slider assembly and said screed head assembly are slid from a distal end of said boom to a proximal end of said boom attached to said mounting assembly.

18. The method of claim 16, further comprising:

operating said auger actuator to pivot said auger assembly so that said second auger is positioned lower than said first auger and positioned at least partially within the material to be screeded.

19. The method of claim 16, further comprising:

operating a vibration actuator positioned on said finish plate assembly, wherein said vibration actuator is operable to vibrate said finish plate assembly to smooth the material being screeded as the screed head assembly is slid along the length of said boom.

20. The method of claim 16, further comprising:

attaching the screeding apparatus to a vehicle, wherein said screeding apparatus is attached to the vehicle at a tilt rotator assembly of said mounting assembly; and wherein said tilt rotator assembly is rotatable with respect to a base of said mounting assembly.

* * * * *